US010913008B2

(12) United States Patent
Hamel

(10) Patent No.: US 10,913,008 B2
(45) Date of Patent: Feb. 9, 2021

(54) MANIPULATIVE DEVICE

(71) Applicant: Jonathan Hamel, Coral Gables, FL (US)

(72) Inventor: Jonathan Hamel, Coral Gables, FL (US)

( * ) Notice: Subject to any disclaimer, the term of this patent is extended or adjusted under 35 U.S.C. 154(b) by 0 days.

(21) Appl. No.: 16/671,862

(22) Filed: Nov. 1, 2019

(65) Prior Publication Data

US 2020/0061483 A1 Feb. 27, 2020

Related U.S. Application Data

(60) Provisional application No. 62/755,121, filed on Nov. 2, 2018.

(51) Int. Cl.
*A63H 33/00* (2006.01)

(52) U.S. Cl.
CPC ..... *A63H 33/00* (2013.01)

(58) Field of Classification Search
CPC ..... A63H 33/00; A63H 33/26
USPC ..... 446/131, 132, 134, 138, 266, 489; 224/183; 473/406
See application file for complete search history.

(56) References Cited

U.S. PATENT DOCUMENTS 2,987,852 A * 6/1961 Koch ..... A63H 33/26 446/139
4,386,774 A * 6/1983 Buckman ..... A63B 57/00 473/406
4,486,729 A * 12/1984 Lee ..... H01F 7/0236 335/306
4,871,340 A * 10/1989 Ross ..... A63H 33/26 446/132
4,964,830 A * 10/1990 Wagner ..... A63H 33/26 335/285
6,033,322 A * 3/2000 England ..... A63B 57/50 473/408
6,150,913 A * 11/2000 Simmons ..... A63F 9/16 273/456
6,569,039 B1 * 5/2003 Cope ..... A63B 57/353 473/406
6,641,895 B1 * 11/2003 Adams ..... A63H 33/26 428/133
7,004,858 B2 * 2/2006 Bauley ..... A63B 57/207 473/408

(Continued)

*Primary Examiner* — Joseph B Baldori
(74) *Attorney, Agent, or Firm* — Patentfile, LLC; Bradley C. Fach; Steven R. Kick

(57) ABSTRACT

A manipulative device may include a revolving body, having a first perimeter, and a housing. The housing may comprise a retaining body, having a second perimeter, and the revolving body may be removably coupled to the housing via a magnetic attraction between the revolving body and the retaining body. A channel may be formed into the housing. The first perimeter may be movably received in the channel, and the first perimeter may be retained in the channel via the magnetic attraction between the revolving body and the retaining body. Optionally, the housing may comprise a receptacle which may be shaped to receive portions of the revolving body. A user may manipulate the revolving body and housing in one hand, experiencing both the attraction forces and the repelling forces of magnetically attracted objects thus achieving relief from boredom and anxiety or more focused thought and calm in meditation.

12 Claims, 11 Drawing Sheets

(56) References Cited

U.S. PATENT DOCUMENTS

| | | | | |
|---|---|---|---|---|
| 7,189,166 | B2 * | 3/2007 | Pare | A63B 55/10 473/282 |
| 7,275,974 | B2 * | 10/2007 | Perry | A63H 1/02 273/109 |
| 8,881,437 | B1 * | 11/2014 | McGrath | G09F 3/20 40/1.6 |
| 8,985,410 | B2 * | 3/2015 | Wishart | A44C 5/0007 224/183 |
| 10,307,687 | B2 * | 6/2019 | Umberger | A63H 33/26 |
| 2007/0298677 | A1 * | 12/2007 | Hoffman | A63H 33/26 446/129 |
| 2009/0061727 | A1 * | 3/2009 | Styles | A63H 33/28 446/15 |
| 2011/0009214 | A1 * | 1/2011 | Steinberg | A63B 57/207 473/406 |
| 2013/0217518 | A1 * | 8/2013 | Miller | A63B 57/207 473/406 |

* cited by examiner

MANIPULATIVE DEVICE

CROSS REFERENCE TO RELATED APPLICATIONS

This application claims priority to and the benefit of the filing date of U.S. Provisional Application No. 62/755,121, filed on Nov. 2, 2018, entitled "MANIPULATIVE DEVICE", which is hereby incorporated by reference in its entirety.

FIELD OF THE INVENTION

This patent specification relates to the field of amusement devices. More specifically, this patent specification relates to a handheld amusement device.

BACKGROUND

Handheld amusement devices which can be manipulated by individuals have become very popular and are commonly referred to as fidget toys and fidget spinners. These devices often include one or more elements which may be repeatedly moved or manipulated by the hands of the users. Users of these devices promote them as helping people who have trouble focusing or those who fidget to relieve nervous energy, anxiety, or psychological stress. However, existing devices are limited in the way their elements may be moved or manipulated. For example, most devices of this kind allow for a binary pattern of movement (e.g., up/down, left/right, in/out), and these repetitive movements feel the same to the user every time and are therefore not engaging to the user over longer periods of time. For this reason, most users quickly tire of using these current devices.

Therefore, a need exists for novel amusement and fidget devices. There is also a need for novel handheld amusement and fidget devices. A further need exists for novel amusement and fidget devices that are not limited to a binary pattern of movement. Finally, a need exists for novel amusement and fidget devices in which movements initiated by the user, even repetitive movements, feel different every time and are therefore more engaging to the user over a longer period of time.

BRIEF SUMMARY OF THE INVENTION

A novel manipulative device is provided. Preferably, the device may provide a compact, hand-held instrument to alleviate boredom, relieve anxiety, or promote more focused thinking or meditation by allowing user to manipulate two magnetically attracted objects in one hand, experiencing both the attraction forces of magnetically attracted objects and the repelling forces of magnetically attracted objects. The device provides an entirely unique user experience and an extraordinary level of tactile satisfaction through its manipulation.

In some embodiments, the device may include a housing and a revolving body, the revolving body having a first perimeter. The housing may comprise a retaining body, having a second perimeter, and the revolving body may be removably coupled into contact with the housing via a magnetic attraction between the revolving body and the retaining body. A channel may be formed into the housing, and the channel may encircle the second perimeter. The first perimeter may be movably received in the channel, and the first perimeter may be retained in the channel via the magnetic attraction between the revolving body and the retaining body so that the revolving body 11 may be revolved around the housing while the first perimeter is in the channel.

In further embodiments, the housing may comprise a receptacle which may be shaped to receive portions of the revolving body.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
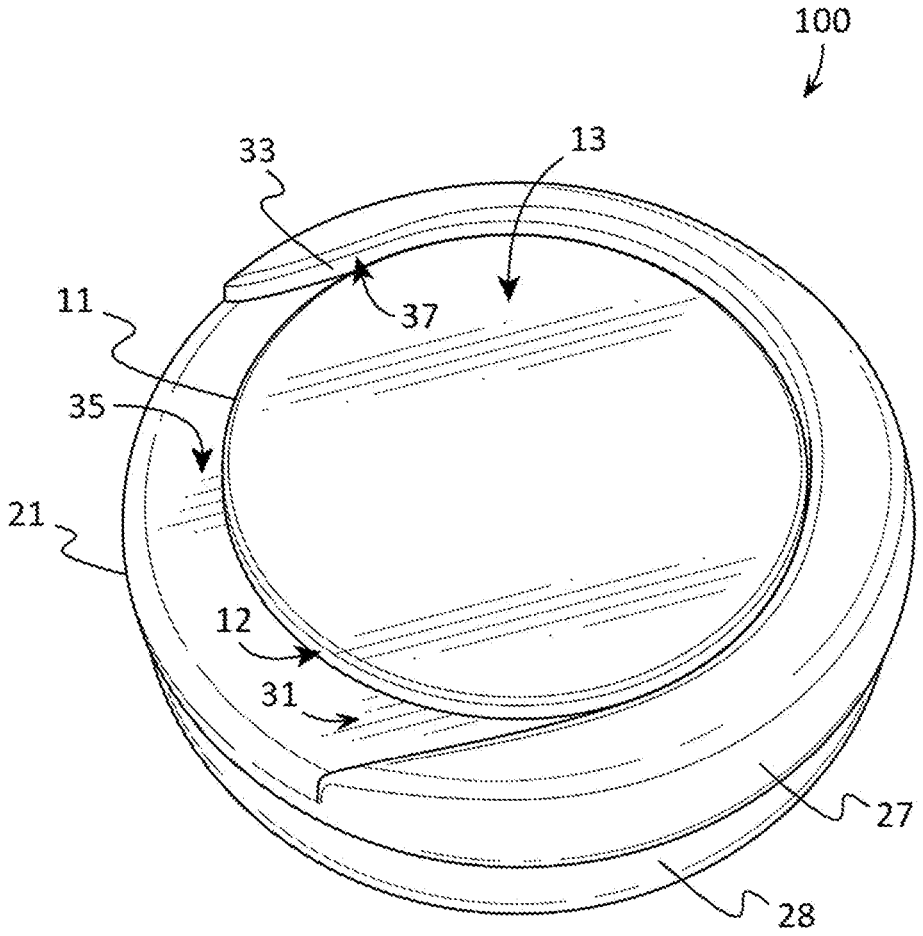
FIG. 1 depicts a top perspective view of an example of a manipulative device according to various embodiments described herein.
Figure 2A:
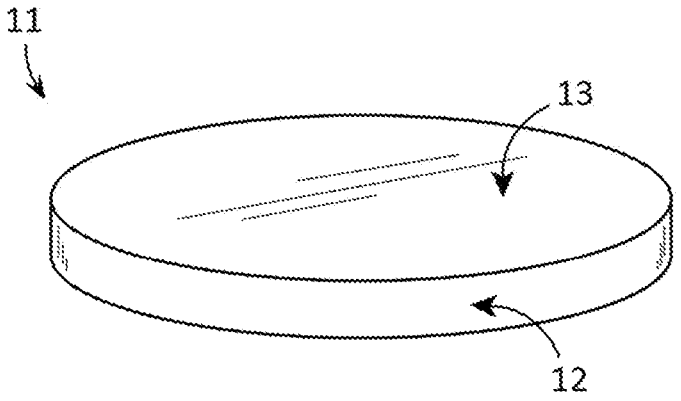
FIG. 2A illustrates a top perspective view of an example of a revolving body according to various embodiments described herein.
Figure 2B:
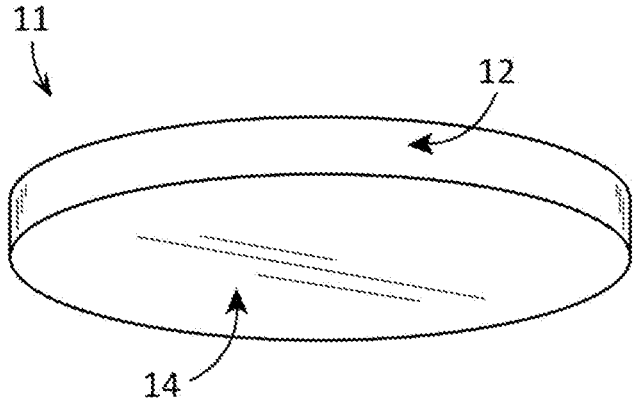
FIG. 2B shows a bottom perspective view of an example of a revolving body according to various embodiments described herein.
Figure 3:
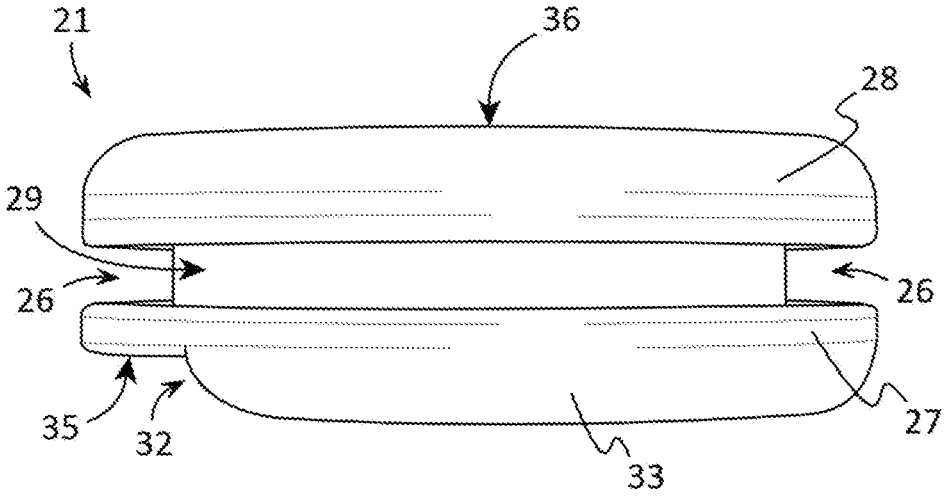
FIG. 3 depicts a first side elevation view of an example of a housing according to various embodiments described herein.
Figure 4:
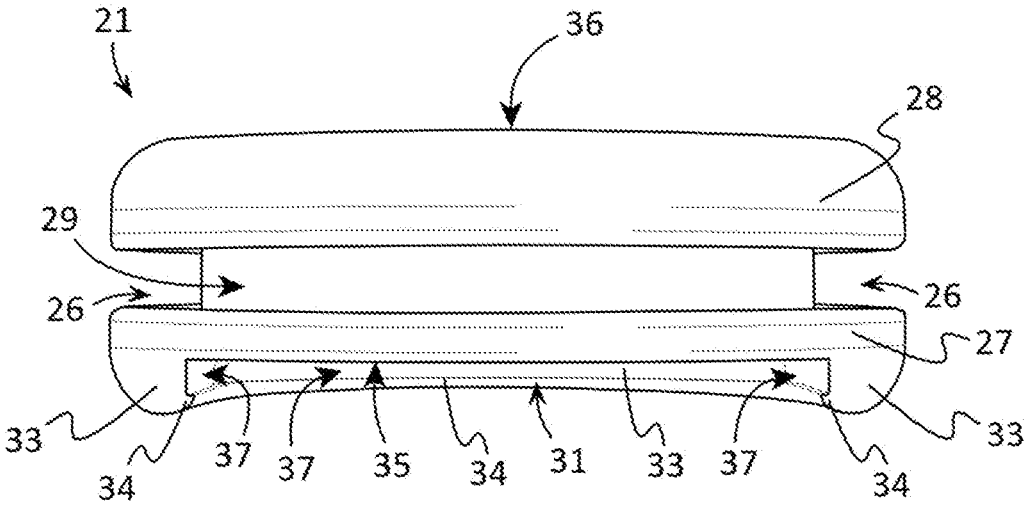
FIG. 4 illustrates a second side elevation view of an example of a housing according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new manipulative device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1, 8-10 illustrate examples of a manipulative device ("the device") 100 according to various embodiments. In some embodiments, the device 100 may comprise a revolving body 11, having a first perimeter 12, and a housing 21. The housing 21 may comprise a retaining body 22, having a second perimeter 23, and the revolving body 11 may be removably coupled into contact with the housing 21 via a magnetic attraction between the revolving body 11 and the retaining body 12. A channel 26 may be formed into the housing 21, and the channel 26 may encircle the second perimeter 23. The first perimeter 12 may be movably received in the channel 26, and the first perimeter 12 may be retained in the channel 26 via the magnetic attraction between the revolving body 11 and the retaining body 22. Optionally, the housing 21 may comprise a receptacle 31 which may be shaped to receive portions of the revolving body 11.

In some embodiments, a revolving body 11 may be generally disc shaped, such as a squat cylinder shape, having a circular and planar first surface 13, a circular and planar second surface 14 approximately equal in size and parallel to the first surface 13, and a first perimeter 12 separating the first surface 13 from the second surface 14. In other embodiments, a revolving body 11 may be configured in any other shape, preferably having two opposing surfaces 13, 14, of any shape and size which may be separated by a first perimeter 12.

In some embodiments, a retaining body 22 may be generally disc shaped, such as a squat cylinder shape, having a circular and planar first surface 24, a circular and planar second surface 25 approximately equal in size and parallel to the first surface 24, and a second perimeter 23 separating the first surface 24 from the second surface 25. In other embodiments, a retaining body 22 may be configured in any other shape, preferably having two opposing surfaces 24, 25, of any shape and size which may be separated by a second perimeter 23.

The revolving body 11 and the retaining body 22 may each comprise or be made of a magnetic material which may allow the bodies 11, 22, to be magnetically attracted to each other. In some embodiments, a magnetic material may comprise a high-coercivity ferromagnetic compound type of magnetic material such as ferric oxide mixed with a plastic binder. In other embodiments, a magnetic material may comprise ferrite, manganese-zinc ferrite, nickel-zinc ferrite, strontium ferrite, cobalt ferrite, barium ferrite, magnetic alloys such as alnico, comol, Hypernom® magnetic alloy, manganese-zinc ferrite, iron-silicon magnet alloys, nickel-zinc ferrite, ferritic stainless steel alloys, strontium ferrite, barium ferrite, alnico, iron-silicon magnet alloy, Chromindur® (Chromium-Cobalt-Iron) alloys, Silmanal (Silver-Manganese-Aluminium) alloys, Platinax II (platinum-cobalt) alloy, Bismanol (manganese bismuthide) alloy, cobalt-platinum alloys, chromium-manganese antimonide alloy, vectolite (cobalt ferrite), magnadur (sintered barium ferrite), lodex (oxide-coated iron-cobalt particles), awaruite (Ni2Fe to Ni3Fe nickel-iron alloy), wairauite, rare earth magnets such as samarium-cobalt, cesium-cobalt, neodymium-iron-boron, other neodymium magnet materials, metallic oxides such as magnetite, ulvospinel, hematite, ilmenite, maghemite, jacobsite, iron sulfides such as pyrrhotite, greigite, troilite, metallic oxyhydroxides such as goethite, lepidocrocite, feroxyhyte, ferrimagnetic materials such as magnetite, pyrrhotite, cubic ferrites, hexagonal ferrites, ferromagnetic materials including metals such as iron, nickel, cobalt, metal alloys containing iron, nickel, and/or cobalt, soft magnetic materials, hard magnetic materials, or any other suitable magnetic material, that is capable of magnetically adhering to another magnetic material through the principle of magnetism.

In preferred embodiments, the magnetic material of a revolving body 11 may be magnetized axially such that the first surface 13 and second surface 14 may comprise opposing poles of the magnetic material. For example, the first surface 13 may be the north pole of the magnetic material while the second surface 14 may be the south pole of the magnetic material, or vice versa. Likewise, the magnetic material of a retaining body 22 may be magnetized axially such that the first surface 24 and second surface 25 may comprise opposing poles of the magnetic material. For example, the first surface 24 may be the south pole of the magnetic material while the second surface 25 may be the north pole of the magnetic material, or vice versa. In alternative embodiments, the magnetic material of the bodies 11, 22, may be configured with any other orientation.

The device 100 may include a housing 21 which may cover or surround all or portions of the retaining body 22. In some embodiments, the housing 21 may comprise a first case 27 and a second case 28 which may each be generally disc shaped. A first case 27 may comprise a first case surface 35, and a second case 28 may comprise a second case surface 36. The revolving body 11 may be removably coupled into contact with the first case surface 35 and/or the second case surface 36 via the magnetic attraction between the revolving body 11 and the retaining body 22. The case surfaces 35, 36, may provide surfaces against which the surfaces 13, 14, of the revolving body 11 may rest against due to the magnetic attraction between the bodies 11, 22. In some embodiments, a first case surface 35 may be opposingly positioned (on the housing 21) to the second case surface 36.

In further embodiments, the first case 27 and second case 28 may each be configured with a generally disc shape that may be larger than the disc shape of the retaining body 22, and the retaining body 22 may be sandwiched between the cases 27, 28. In some embodiments, a first case 27 and/or a second case 28 may comprise a general disc shape that may be between approximately, 10 and 70 percent, and more preferably between 25 and 55 percent, larger that the disc shape of the retaining body 22.

Figure 5:
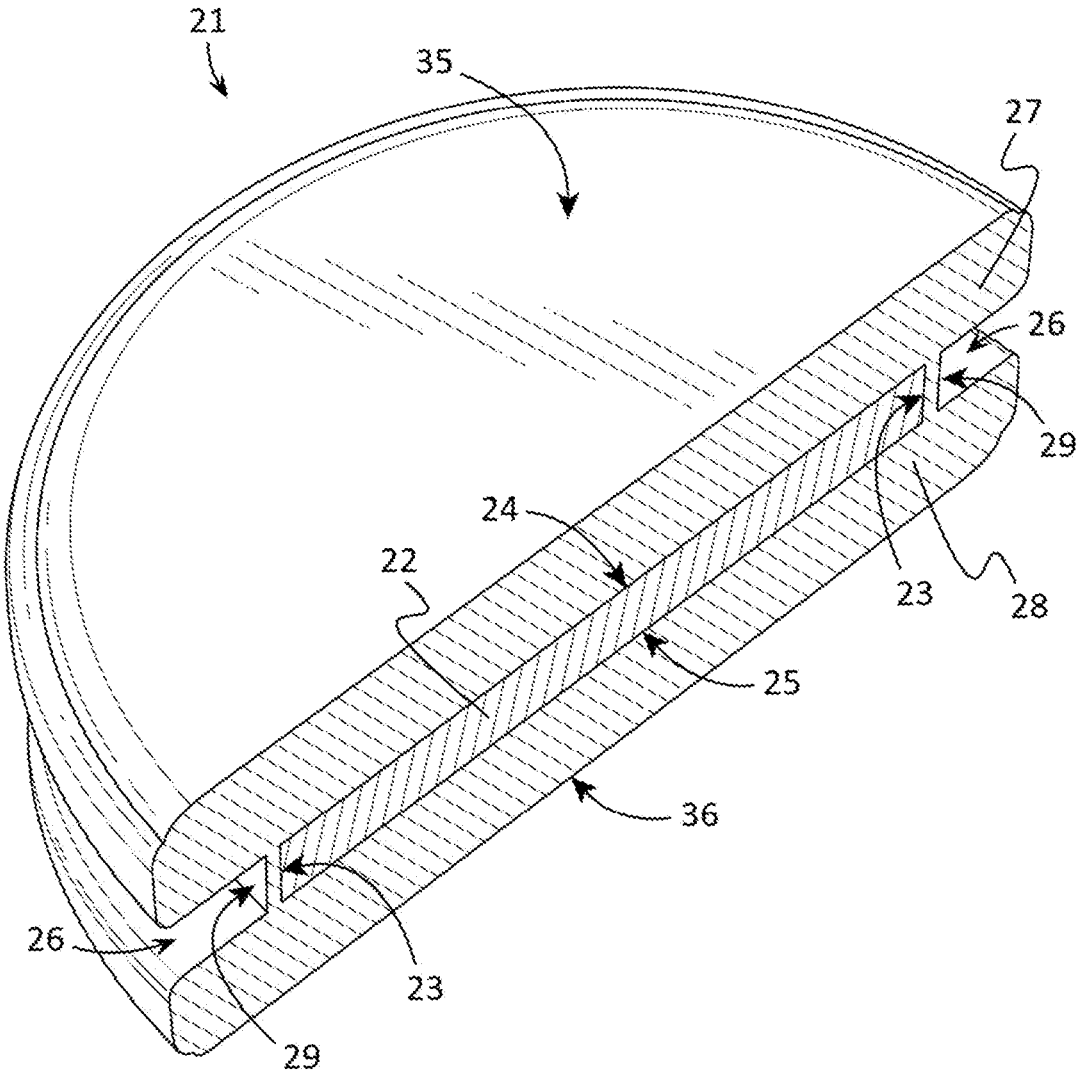
FIG. 5 shows a sectional elevation view of an example of a housing according to various embodiments described herein.
Figure 6:
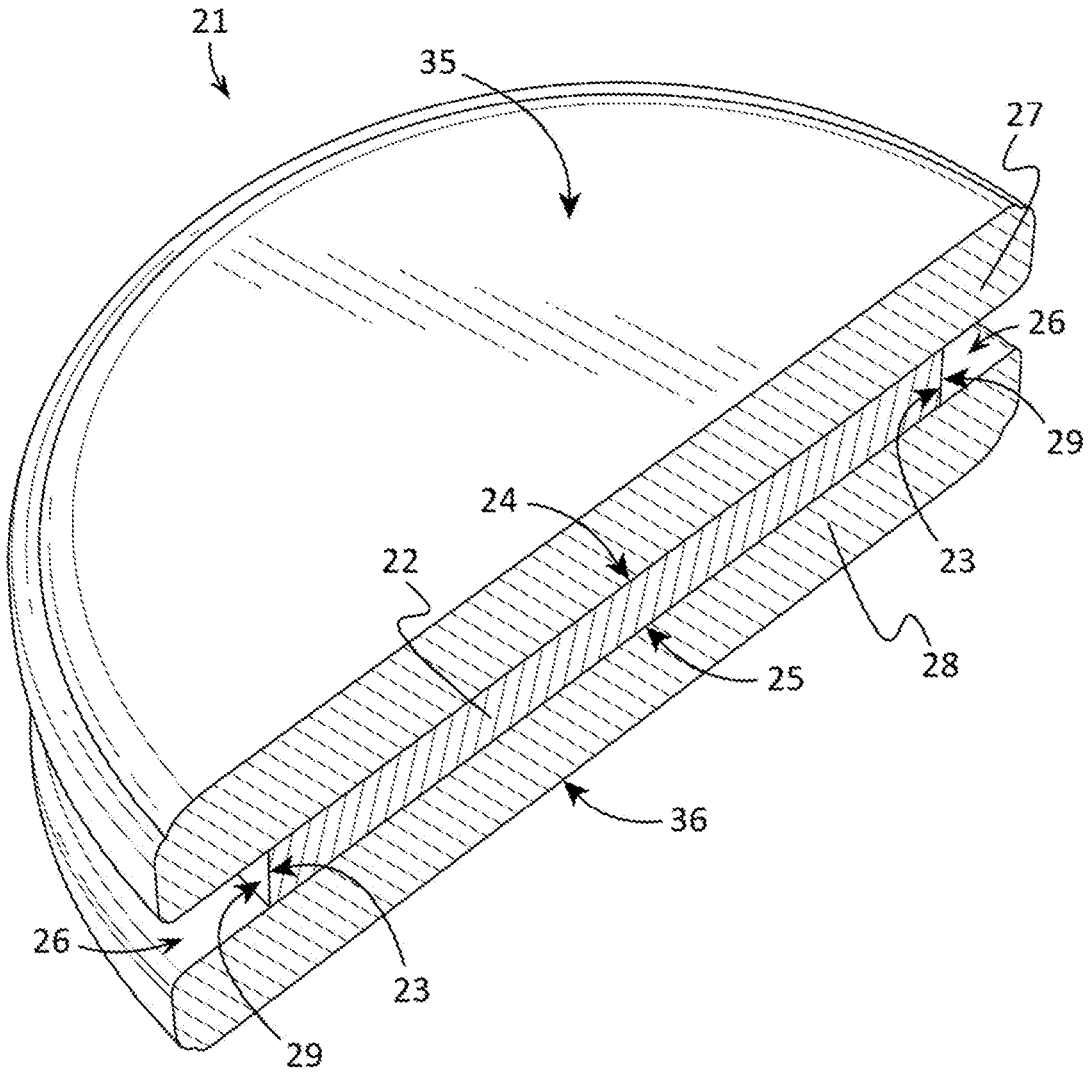
FIG. 6 depicts a sectional elevation view of another example of a housing according to various embodiments described herein.
Figure 7A:
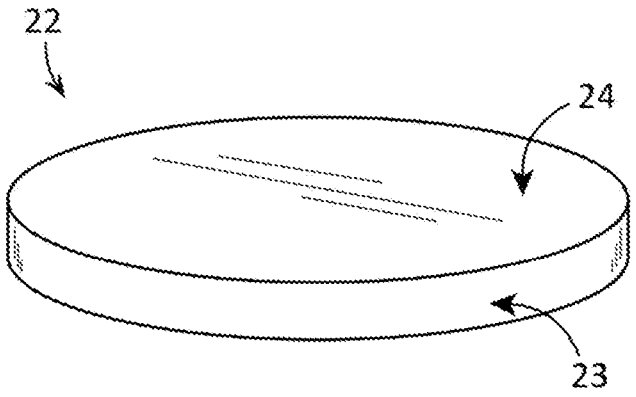
FIG. 7A illustrates a top perspective view of an example of a retaining body according to various embodiments described herein.
Figure 7B:
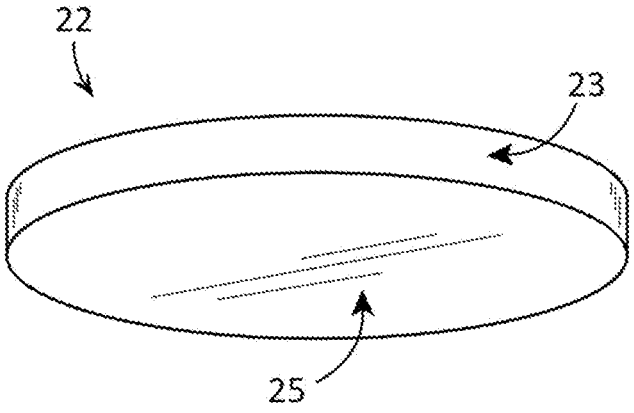
FIG. 7B shows a bottom perspective view of an example of a retaining body according to various embodiments described herein.

The cases 27, 28, may be separated by a revolving surface 29, and preferably the revolving surface 29 may separate the cases 27, 28, by a uniform distance. Generally, the first perimeter 12 of a revolving body 11 may be retained in contact with the revolving surface 29 and in the channel 26 of the housing 21 via the magnetic attraction between the revolving body 11 and the retaining body 22. In some embodiments, the revolving surface 29 may be generally cylindrical in shape having a diameter that may be approximately equal to or greater than the diameter of the retaining body 22. In further embodiments, the revolving surface 29 may surround the second perimeter 23 of the retaining body 22 of the housing 21 so that the revolving surface 29 and second perimeter 23 may be approximately concentric (FIG. 5). In other embodiments, the revolving surface 29 may be formed by the second perimeter 23 of the retaining body 22 of the housing 21 (FIG. 6).

In preferred embodiments, the housing 21 may comprise a channel 26 that may be formed by the revolving surface 29 and portions of the first case 27 and second case 28. Preferably, the first case 27 and second case 28 may each comprise a generally disc shape that may be larger than the disc shape of the retaining body 22, and the first case 27 and second case 28 may be separated by the revolving surface 29 thereby forming the channel 26. In further preferred embodiments, the width of the revolving surface 29 may be larger than the width of the first perimeter 12 so that the first perimeter 12 may be received in the channel 26, thereby allowing the first perimeter 12 to contact and roll around the revolving surface 29 so that the revolving body 11 may revolve around the housing 21. In this manner portions of the revolving body 11, such as portions of the first perimeter 12, first surface 13, and second surface 14, may be movably received in the channel 26, and the portions of the revolving body 11, such as the portions of the first perimeter 12, first surface 13, and second surface 14, may be retained in the channel 26 via the magnetic attraction between the revolving body 11 and the retaining body 22.

In some embodiments, the device 100 may comprise a receptacle 31 which may be shaped to receive portions of the revolving body 11. In preferred embodiments, the receptacle 31 may comprise a receptacle opening 32 which may facilitate moving the revolving body 11 into and out of the receptacle 31. For example, a surface 13, 14, of the revolving body 11 may be positioned in the receptacle 31 and magnetically adhered to the housing 21. A user 200 may slide the revolving body 11 into and out of the receptacle 31 while increasing portions and decreasing portions, respectively, of the surface 13, 14, are magnetically adhered to the housing 21.

A receptacle 31 may comprise a sidewall 33 which may extend away or above a case surface 35, 36, (depending on which case 27, 28, the receptacle 31 is disposed on). In some embodiments, a sidewall 33 may be formed by portions of the housing 21, such as the first case 27 and/or second case 28. In other embodiments, a sidewall 33 may be coupled to portions of the housing 21, such as the first case 27 and/or second case 28.

Figure 11:
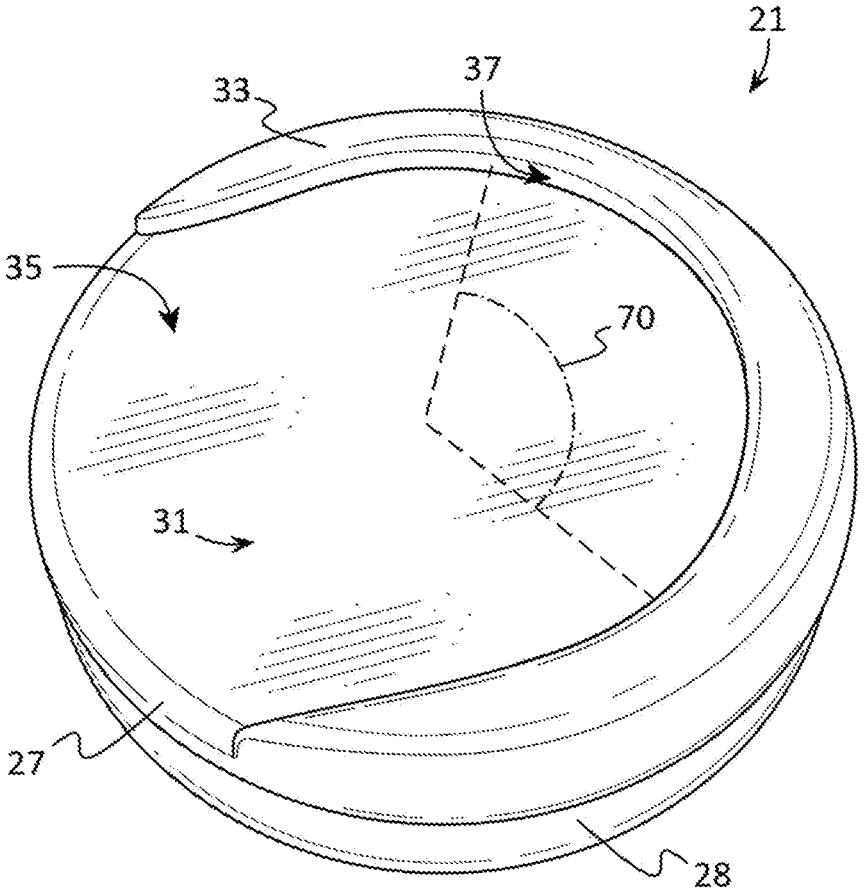
FIG. 11 shows a top perspective view of an example of a retaining body of a manipulative device according to various embodiments described herein.

A side wall 33 may comprise a sidewall surface 37 which may be generally C-shaped or U-shaped with the receptacle opening 32 forming the open part of the C-shape or U-shape, respectively. Preferably, a sidewall surface 37 may comprise an arc shape 70 (perhaps best shown in FIG. 11) which portions of the first perimeter 12 may rest against when the revolving body 11 is received in the receptacle 31. Generally, an arc shape 70 may comprise an arc of between approximately 0.1 and 180 degrees. For example, a sidewall surface 37 being generally C-shaped or U-shaped may comprise an arc shape 70 of approximately 180 degrees.

Figure 12:
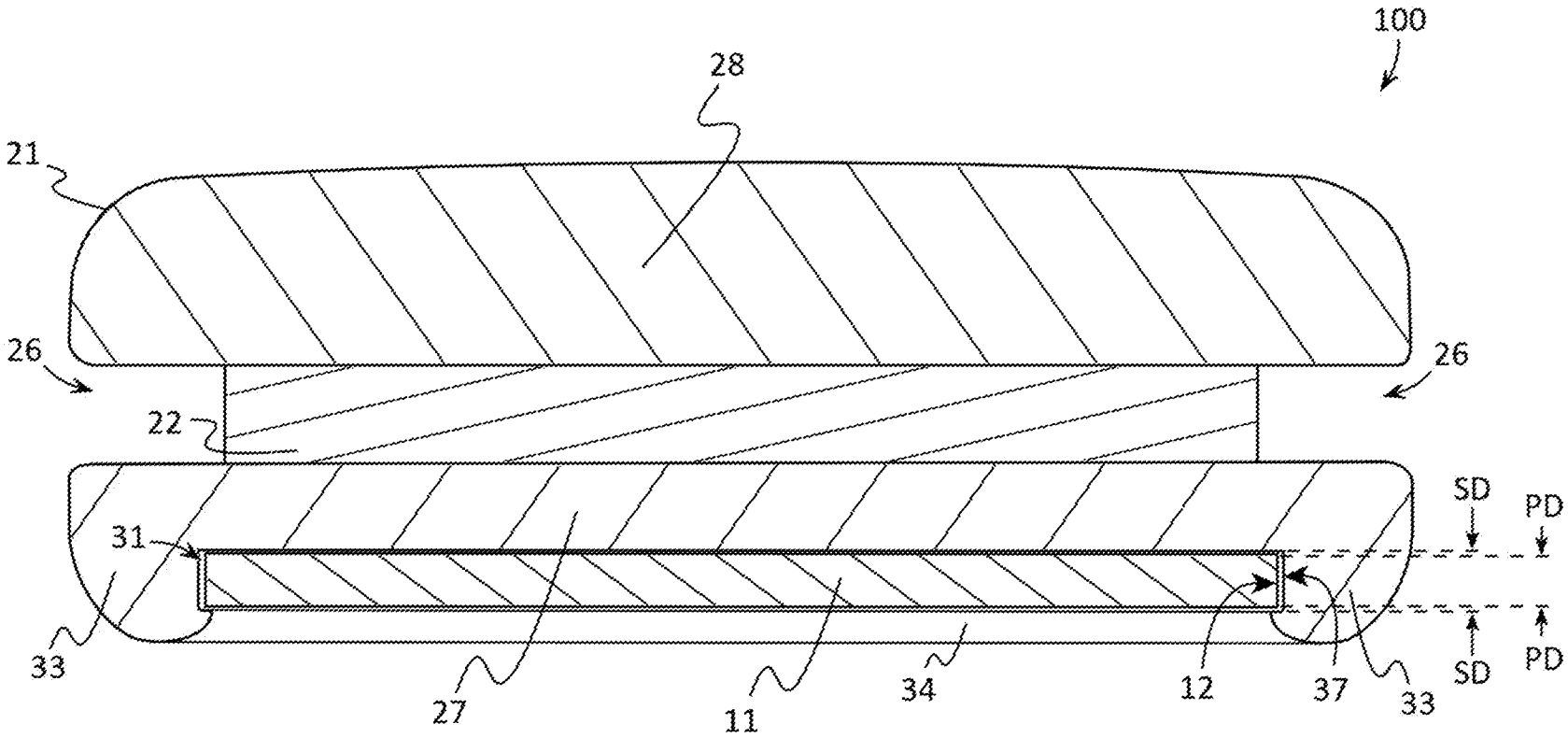
FIG. 12 illustrates a sectional, elevation view of an example of a manipulative device according to various embodiments described herein.

In preferred embodiments, and as shown in FIG. 12, a sidewall surface 37 may comprise a sidewall surface dimension (SD) and the first perimeter 12 of a revolving body 11 may comprise a first perimeter dimension (PD), and the sidewall surface dimension (SD) may be greater than the first perimeter dimension (PD). In other embodiments, a sidewall surface dimension (SD) may be less than or equal to the first perimeter dimension (PD).

Optionally, the device 100 may comprise a receptacle lip 34 which may be coupled along upper portions of the sidewall 33 and which may extend away from the sidewall 33 and sidewall surface 37 so that the receptacle lip 34 may contact or be positioned above and/or proximate to the surface 13, 14, of the revolving body 11 that is not magnetically adhered to the housing 21 within the receptacle 31.

Figure 8:
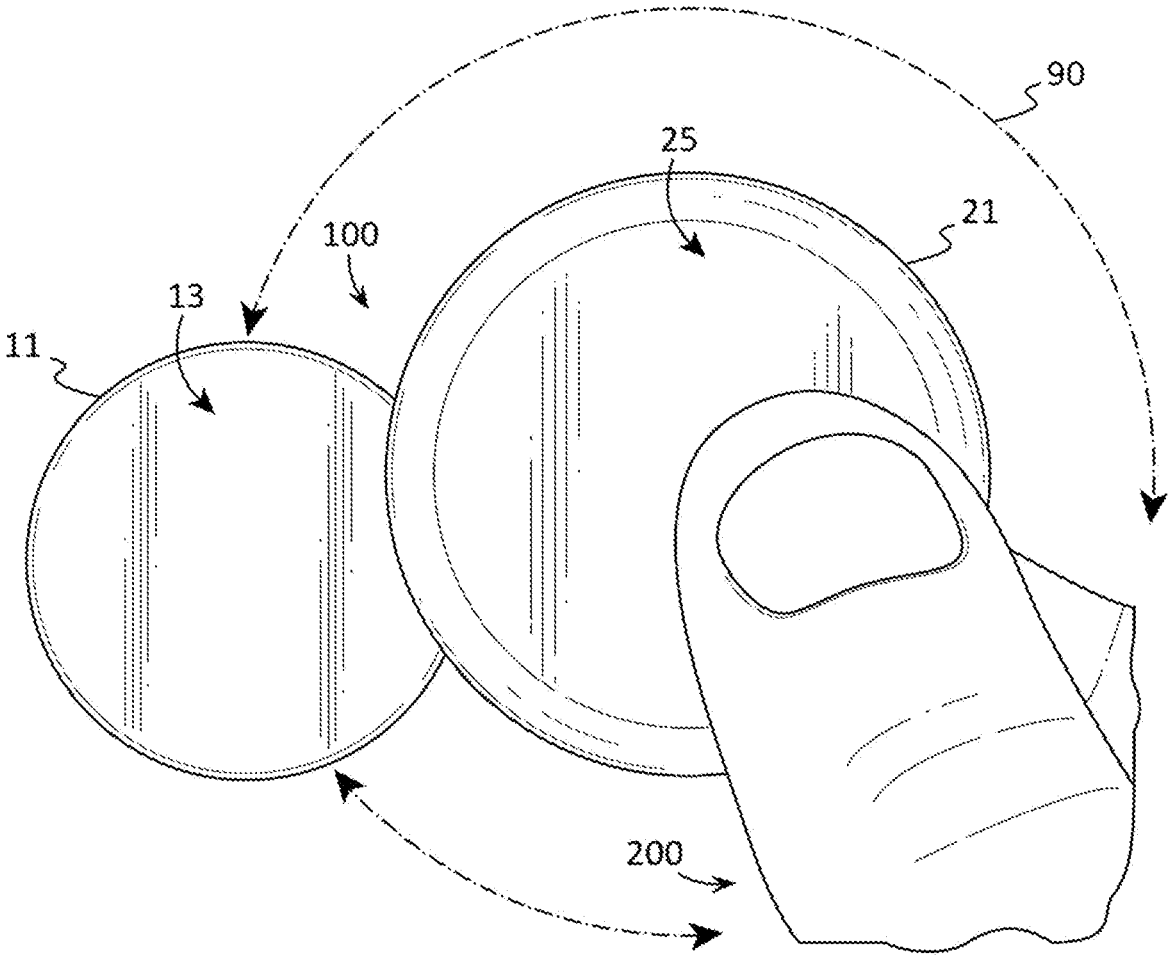
FIG. 8 depicts a perspective view of an example of a user manipulating the manipulative device showing the revolving body positioned in the channel and revolving around the housing according to various embodiments described herein.
Figure 9:
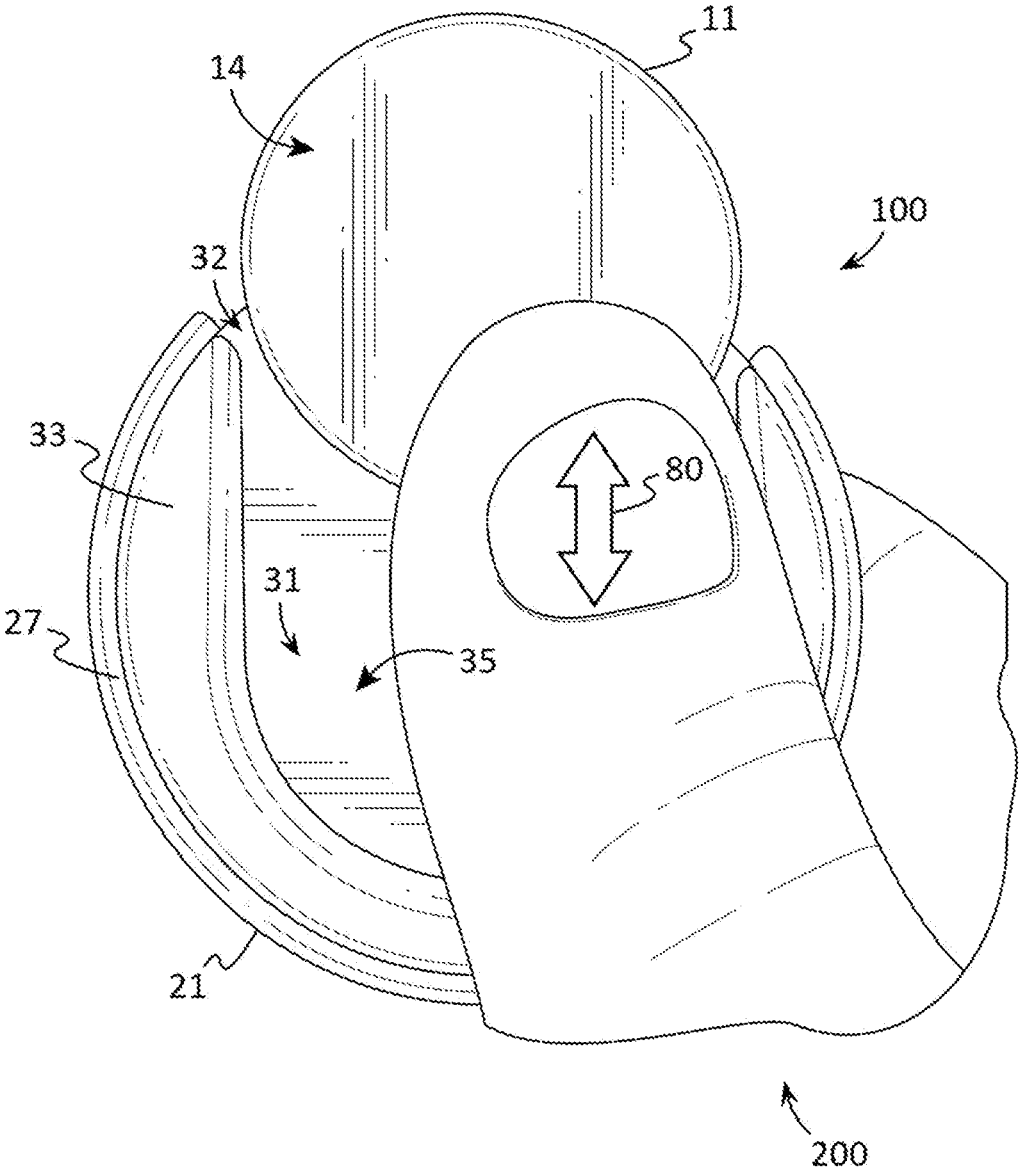
FIG. 9 illustrates a perspective view of an example of a user manipulating the manipulative device showing the revolving body moving in and out of a channel disposed on a first case of the housing according to various embodiments described herein.
Figure 10:
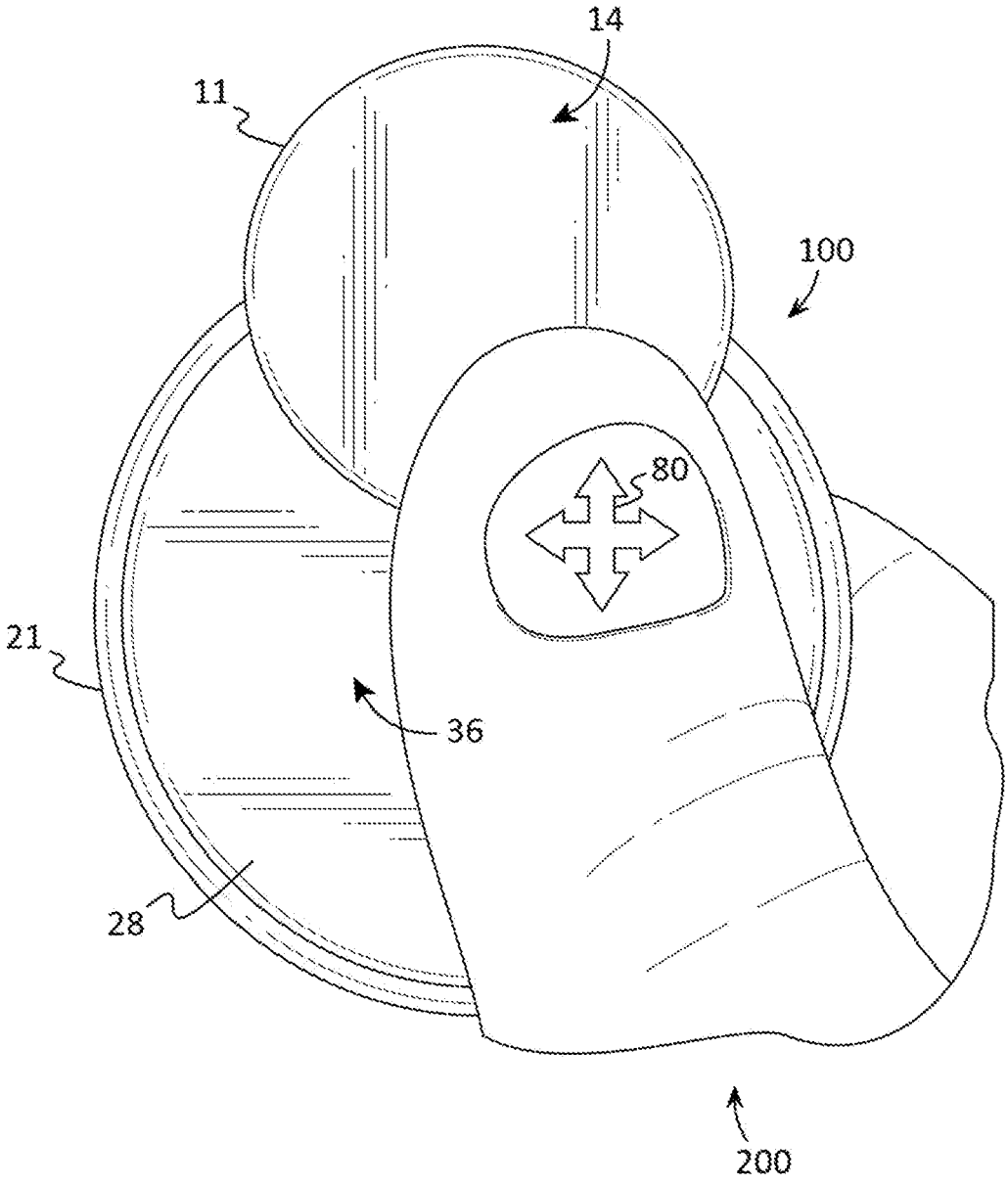
FIG. 10 depicts a perspective view of an example of a user manipulating the manipulative device showing the revolving body moving in any direction on a second case of the housing according to various embodiments described herein.

As perhaps best shown by FIGS. 8-10 a user 200 may manipulate the device 100 with their hand(s) to alleviate boredom, relieve anxiety, promote more focused thinking, explore the characteristics of magnetically attracted objects, and/or any other purpose. For example, in a resting state, the revolving body 11 may rest on the housing 21 within a receptacle 31 that allows for the revolving body 11 to lie flush to a surface of the housing 21 formed by a case 27, 28. Optionally, the opposite case 27, 28, of the housing 21 may not comprise a receptacle 31 but may be generally smooth. From the resting state, the user 200 can slide the revolving body 11 in and out of the receptacle 31 (shown via finger/body movement 80 arrows) using the thumb or other fingers (FIG. 9). The user 200 can slide the revolving body 11 backwards and forwards while it still remains in the receptacle 31 or the user 200 can push the revolving body 11 far enough to create a gap between the revolving body 11 and the sidewall 33 of the receptacle 31—far enough to create a physical space between the two, but close enough to still feel the sensation of attraction and repulsion as the user 200 manipulates the orientation of the revolving body 11 relative to the housing 21. The user 200 can also flip the housing 21, attaching the revolving body 11 to the opposite side or case 27, 28, (without the receptacle 31) and make the same sliding movements, but in a 360-degree range of motion (shown via finger/body movement 80 arrows) without the constraint of the receptacle 31 (FIG. 10).

Once the user has dislodged the revolving body 11 from the receptacle 31, it is then possible to allow the revolving body 11 to enter the channel 26 of the housing 21 where it will reconnect (exclusively by magnetic force) to the housing 21. At this point, the user 200 can hold the housing 21 from the first case 27 and the second case 28 and allow the revolving body 11 to revolve around the housing 21 (shown with revolving movement 90) in the channel 26, spinning the revolving body 11 slowly or quickly, with the revolving body 11 remaining attached given that the magnetic force of attachment between the opposite poles is greater than the centrifugal force of the revolutions of the revolving body 11 around the housing 21 (FIG. 8).

In addition to the sliding movements created on the case surfaces 35, 36, of the housing 21 when the revolving body 11 is outside the channel 26 and the spinning or revolving movements created when the second magnet is within the channel 26, the user 200 can, with one hand or two, manipulate the revolving body 11 between these two positions, alternating back and forth between one and the other, each time experiencing through these movement the remarkable sensation of push and pull created by the magnetic materials of the bodies 11, 22, as their orientation relative to each other (and their respective poles) changes. This interaction, driven by the user 200 through an infinite variety of permutations of movements between the magnetic materials of the bodies 11, 22, (including, but not limited to those described above), provides a unique tactile experience, fosters a sense of wonder and a greater desire to learn more about the nature of magnetic attraction, in addition to many other benefits.

While some exemplary shapes and sizes have been provided for elements of the device 100, it should be understood to one of ordinary skill in the art that the revolving body 11, housing 21, retaining body 22, channel 26, receptacle, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A manipulative device, the device comprising:

a revolving body having a first perimeter;

a housing comprising a first case and a second case, the first case and the second case each respectively having a first case surface and a second case surface, the second case surface oppositely positioned to the first case surface, the first case surface and the second case surface surrounding a retaining body so that the retaining body is sandwiched between the first case and the second case, and, wherein the retaining body includes a second perimeter, and wherein the revolving body is removably coupled into contact with portions of the housing via a magnetic attraction between the revolving body and the retaining body;

a channel formed into the housing, wherein the channel encircles the second perimeter, wherein the first perimeter is movably received in the channel, and wherein the first perimeter is retained in the channel via the magnetic attraction between the revolving body and the retaining body;

a receptacle configured to removeably receive and store the revolving body, the receptacle having a sidewall surface that extends away from the first case surface;

a revolving surface located in between the first case and the second case and encircling the retaining body and forming an inner part of the channel and wherein the revolving surface is in direct physical contact with the revolving body while the revolving body is rotated around the housing thereby blocking direct physical surface contact between the revolving body and the retaining body; and wherein the revolving surface has a first width and the first perimeter of the revolving body has a second width, the first width of the revolving surface being greater than the second width of the first perimeter so that the first perimeter of the revolving body may be received within the channel thereby allowing the first perimeter to physically contact and roll around the revolving surface.

2. The device of claim 1, wherein the sidewall surface comprises an arc shape.

3. The device of claim 2, wherein the sidewall surface comprises a sidewall surface dimension, wherein the first perimeter comprises a first perimeter dimension, and wherein the sidewall surface dimension is greater than the first perimeter dimension.

4. The device of claim 2, wherein the sidewall surface comprises an arc shape of approximately 180 degrees.

5. The device of claim 4, wherein the revolving body comprises a magnetic material that is magnetized axially such that the first surface and second surface comprise opposing poles of the magnetic material.

6. The device of claim 1, further comprising a receptacle lip.

7. The device of claim 6, wherein the receptacle lip is coupled along upper portions of the sidewall and wherein the receptacle lip extends away from the sidewall.

8. The device of claim 1, wherein the revolving surface is cylindrical in shape.

9. The device of claim 1, wherein the revolving body is disc shaped.

10. The device of claim 9, wherein the revolving body comprises a circular and planar first surface and a circular and planar second surface.

11. The device of claim 1, wherein the retaining body is disc shaped.

12. The device of claim 1, wherein the sidewall surface comprises a sidewall surface dimension (SD), wherein the first perimeter of the revolving body comprises a first perimeter dimension (PD), and wherein the sidewall surface dimension (SD) is greater than the first perimeter dimension (PD).

* * * * *